US005207137A

United States Patent [19]

Baril

[11] Patent Number: 5,207,137

[45] Date of Patent: May 4, 1993

[54] POTATO DICING DEVICE

[76] Inventor: Gary G. Baril, 336 Westbrook St., S. Portland, Me. 04106

[21] Appl. No.: 689,633

[22] Filed: Apr. 23, 1991

[51] Int. Cl.[5] ..... B26D 1/553

[52] U.S. Cl. ..... 83/167; 83/408; 83/437; 83/651.1; 83/857; 83/858; 30/117

[58] Field of Search ..... 83/651.1, 437, 404.3, 83/408, 425.2, 425.3, 167, 856, 857, 858; 30/116, 117

[56] References Cited

U.S. PATENT DOCUMENTS

| | | | |
|---|---|---|---|
| 874,133 | 12/1907 | Stevens | 83/651.1 X |
| 1,705,257 | 3/1929 | Lockett | 30/117 |
| 1,952,033 | 3/1934 | Wittstein | 83/651.1 X |
| 2,023,706 | 12/1935 | Smith | 30/117 |
| 3,112,781 | 12/1963 | Popeil | 83/651.1 X |
| 3,142,905 | 8/1964 | Strasbaugh | 83/651.1 X |
| 3,578,048 | 5/1971 | Van Duyke | 83/651.1 X |
| 4,646,602 | 3/1987 | Bleick | 83/408 |

OTHER PUBLICATIONS

Qualheim Potato Salad Dicer, Qualheim Inc.

*Primary Examiner*—Eugenia Jones

*Attorney, Agent, or Firm*—Laforest S. Saulsbury

[57] ABSTRACT

A dicing device for potatoes and the like adapted to be rested upon the top edge of a pail and having cutting wire portions through which a soft boiled potato is first sliced into horizontally sliced layers while passing onto a grated area and thereafter pushing the sliced layers through grated meshed cutting wires of a horizontal portion to form diced cubes of the potato as they are delivered to the underlying pail. The device generally comprises a horizontal frame portion having mesh cutting wire lengths and a raised portion extending upwardly from the forward end of the horizontal portion with layer cutting wire lengths and through which the full potato is passed to deposit the sliced layers upon the horizontal mesh grating portion. All cutting wires are a solitary wire threaded between opposite sides and ends of the frame portions and wound upon a tightening screw. A top platform assembly will be releasably mounted upon the raised portion with depressible platforms, respectively extending forwardly and rearwardly to support the potato on being pushed through the raised cutting wire portion and to serve a pusher plate for forcing the sliced potato layers through the meshed horizontal portion and into the underlying pail.

5 Claims, 3 Drawing Sheets

POTATO DICING DEVICE

This invention relates to a potato dicing device or utensil.

Heretofore, the dicing of potatoes has been a tedious task in that much hand cutting of peeled and cooked potatoes to dice and prepare for use in soups, chowders, salads and for frying, and the knives and blades which have been used are subjecting cooks to possible injury as in times of rush and making for a time consuming operation. The peeling of the raw potatoes is today machine done eliminating the use of knives for that purpose, while leaving the use of knives for the dicing of the potatoes with the result that uniformly-diced sizes are not obtained. Then, the knives still have to be cleaned, thereby further subjecting the cook to the possibility of being cut from knives.

OBJECTS OF THE INVENTION

It is a principal object of the present invention to provide a device for dicing potatoes that will cut down the time normally required for the dicing of potatoes.

It is another object of the present invention to provide a time saving procedure and device for dicing potatoes without the need for the use of knives or blades for effecting the operation.

It is another object of the invention to provide a potato dicing device that eliminates the tedious labor of hand dicing of cooked peeled potatoes for soups, chowders, homefries and potato salad.

It is still another object of the invention to provide a wire cutting dicing device that will be of stainless steel and easy to clean.

It is still another object of the invention to provide a potato dicer in which elongated wire is strung to make several parallel passes as had from the one wire to make for easy replacement of the wire by simple threading of the wire through open frames and the use of the dicer for cheese, raw vegatables and the like for which stronger wires are needed.

It is still another object of the invention to provide a consistent and uniformly-sized diced cube.

It is a further object of the invention to provide a potato dicer device in which the cutting wire is a continuous wire threaded through the frame with but a single wire and connected to a thumb screw by which the free end of the wire is wound to tighten the wire.

Still further objects of the invention are to provide a potato dicing utensil, having the above objects in mind, which is appearance, effective and efficient in use.

FIGURE DESCRIPTION

For a better understanding of the invention, reference may be had to the following detailed description taken in connection with the accompanying drawing, in which FIG. 1 is an exploded view of the bottom and top assemblies, both in perspective of the potato dicing device or utensil embodying the features of the present invention.

DETAIL DESCRIPTION

Figure 1:
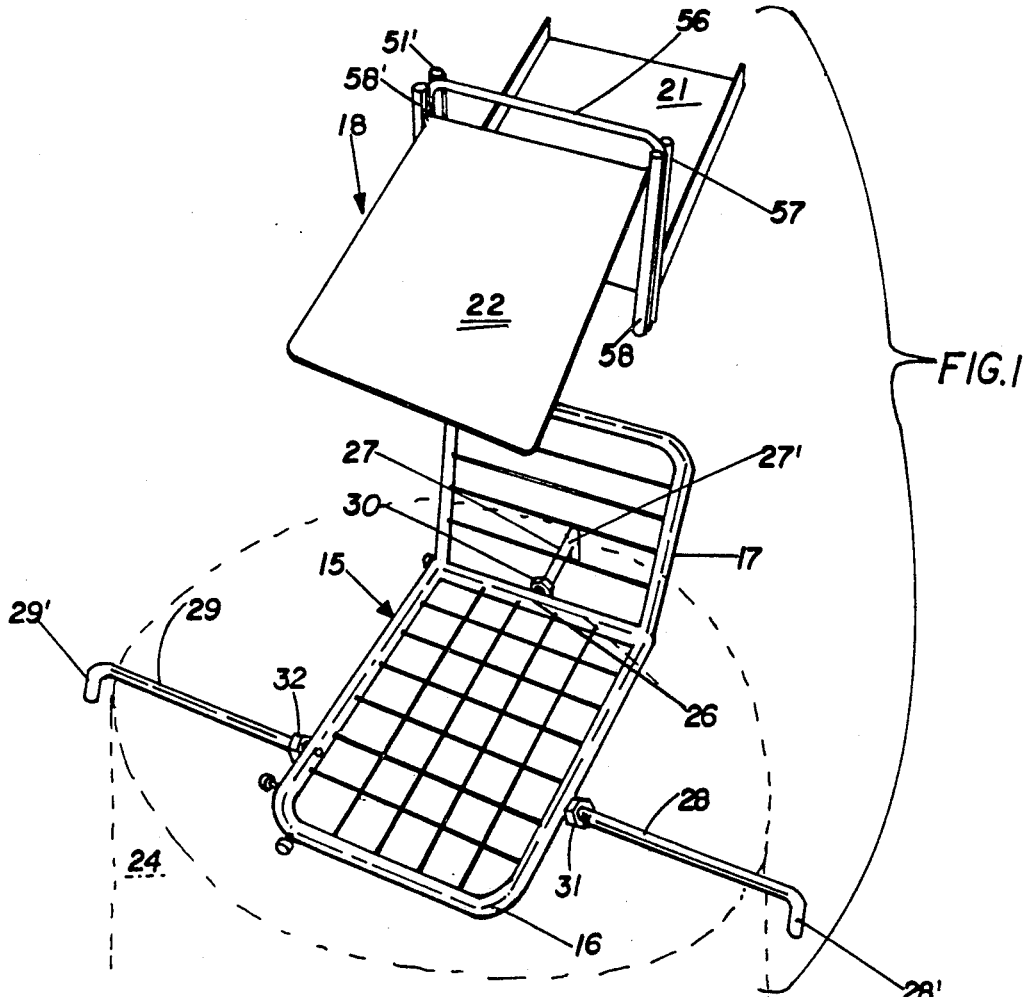
Figure 2:
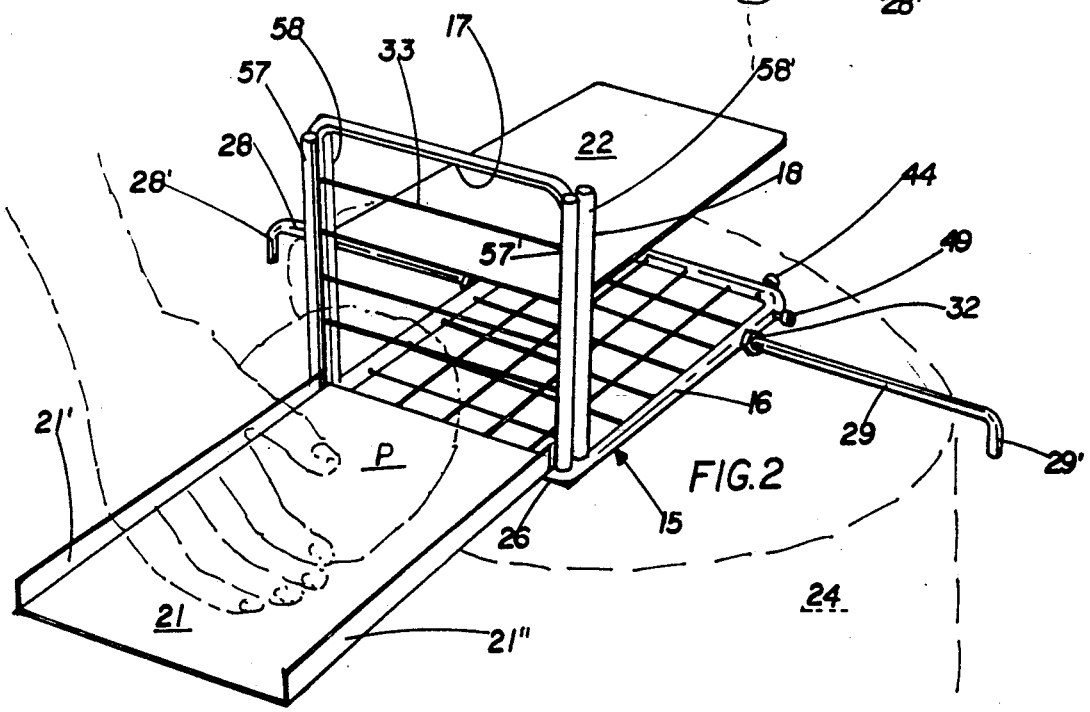
FIG. 2 is an assembled view of the assemblies in perspective, looking upon the front thereof with the potato on the lowered starting platform with illustration made as to the manner in which the assembled utensil is rested on the top edge of a pail and the potato placed upon the platform in readiness to be pushed through the vertically-extended series of cutting wires.
Figure 7:
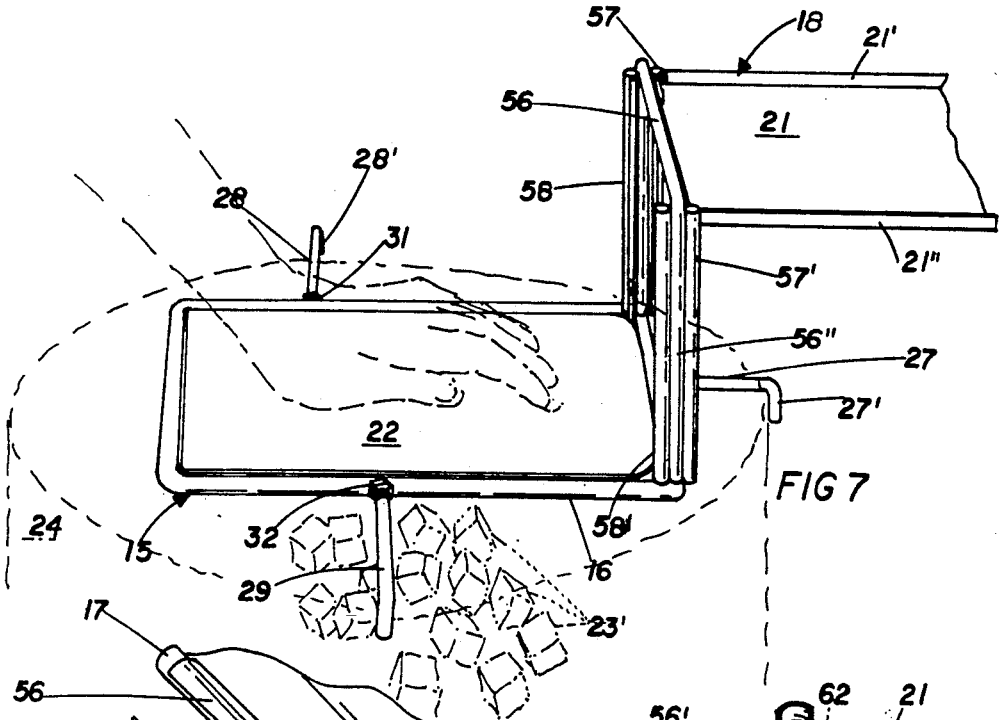
FIG. 7 is a side and top perspective view of the assembled utensil with the platform over the rear mesh wires being forced down to provide the final dicing stroke of the hand to deliver potato cubes into the supporting pail.
Figure 8:
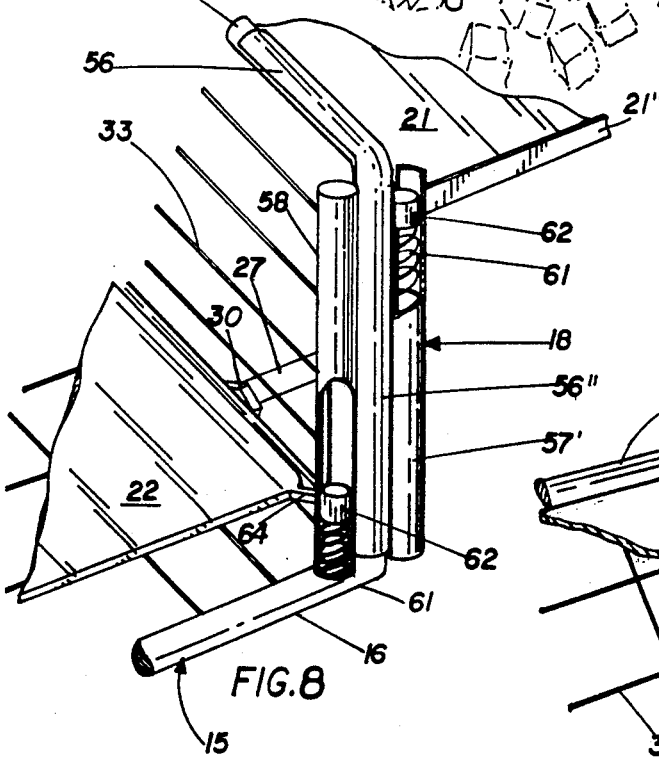
FIG. 8 is an enlarged outside fragmentary perspective view of the joined assemblies and with the spring cylinders broken away to show the plungers and compression springs therewithin.

Referring now to the Figures, this potato dicing device or utensil comprises generally a cutting wire bottom assembly 15 having a horizontal wire mesh final dicing portion 16 with a frontal portion 17 raised vertically upwardly therefrom and at right angles thereto and over which a depressible platform assembly 18 is slid into rigid connection therewith for the application of platforms 21 and 22 for working a soft boiled potato 23 therethrough onto the lower wire mesh dicing bottom assembly 15 and pushed to provide a mass of potato cubes or dicings 23' for delivery into a pail 24 in the manner illustrated in FIGS. 2 and 7.

The horizontal and vertical portions 16 and 17 are formed of round stainless steel stock that serves as framing for cutting wire strung and threaded therebetween. The horizontal portion 16 is closed at the frontal end thereof, from which the frontal portion 17 is bent up raised, by an intermediate frame or crossings connection 26. A pail support rod 27 is threaded into the connection 26 and projects forwardly with a bent down end 27' to hook over the top edge of the pail 24. The support rod 27 is retained in its outwardly adjusted position by a locknut 30. Other support rods 28 and 29 with their respective turned down ends 28' and 29' extend respectively from the respective opposite sides of the horizontal portion 16 at locations with the support rod 27 properly supporting the assemblies upon the top edge of the pail 24. Locknuts 31 and 32 are respectively provided for the respective rods 28 and 29 to retain them in their outwardly adjusted positions.

It should be understood that the bottom assembly 15 is a complete workable unit in itself and the potatoes are barehanded, pushed through the cutting wire gratings.

With the assembly 15 placed alone on the pail 24, the full peeled and cooked potato will be pushed with the full hand through the parallel cutting lengths of a cutting wire 33 threaded in a special manner between the sides of the raised portion 17 FIG. 2. A stack of horizontal potato layers will have landed on the mesh wire horizontal portion 16 and consisting of lengths of a thread wire 34 and crossed longitudinally and meshed with transverse lengths of a threaded wire 36 in order to provide square wire mesh openings through which the potato horizontally sliced layer of the first hand pushing operation are pushed again by hand to obtain the cube dicings 23 that are dropped into the pail 24 as illustrated in FIG. 7. The dicing can thus all be done with the bottom grated assembly 15 by grasping the potato directly with the hand. By use of the platform assembly 18 there will be less chance for the soft potato pieces to be broken FIG. 7.

With most wire gratings, the cutting wire lengths are individual and separately tightened and could not be used with this construction where a smooth raise frame 17 is needed that is free of projections for the top and platform assembly 18 to have a smooth tight fitting of the assembly 18 upon the raised portion 17.

Figure 3:
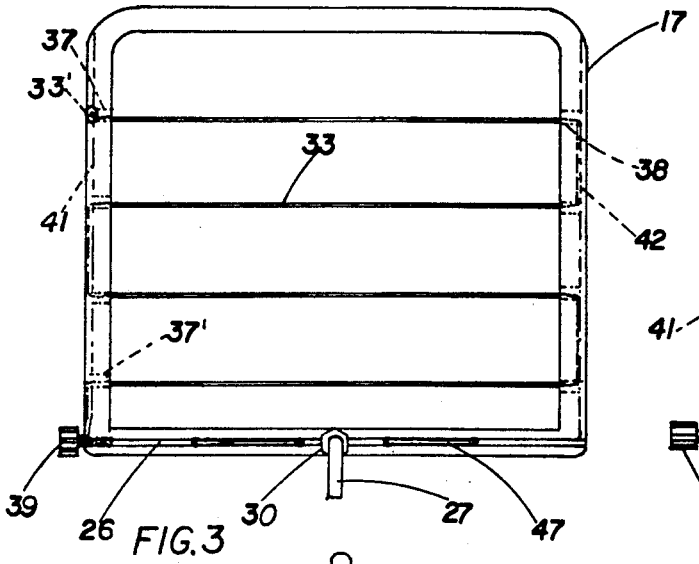
FIG. 3 is a front elevational view of the wire cutting assembly showing a continuous cutting wire that is strung between the side rails of the raised frame and embedded therein to allow for smooth releasable connection of the top platform assembly therewith.
Figure 4:
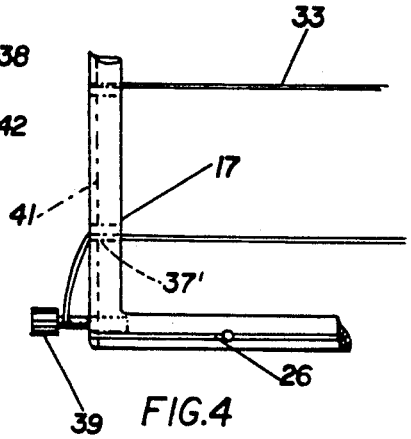
FIG. 4 is an enlarged fragment of a lower corner of the raised frame and showing the tightening knob therefor accessible upon the raised frame and without interference to the connection of the top platform assembly thereupon.

To provide for such a smooth tight fitting, the cutting wire 33 is a continuous thread starting with a hole 37, FIG. 3 near the top of the raised frame portion 17 at one side thereof across to the other side and threaded into more such vertically-spaced holes and extended back on itself to the one side and then back and forth until reaching a bottom hole 37' from which the wire is extended to a winding and tightening thumb screw 39 at the location of the connection 26 out of the way so as not to interfere with the mounting of the platform assembly 18 that is slid down over the sides of the raised frame 17, FIG. 7. The wire 33 is knotted at 33' to come to rest in top hole 37 FIG. 3.

In order to have the sides of the raised frame free of interference to the platform assembly 18 throughout its vertical extent with the cutting wire turns being exposed, the sides of the frame are recessed or undercut respectively at 41 and 42 FIG. 3 to accommodate these vertical extents of the cutting wire 33. By embedding the vertical extents of the wire, the sides of the raised frame will be smooth for the sliding connection of the platform assembly 18 there to.

Figure 5:
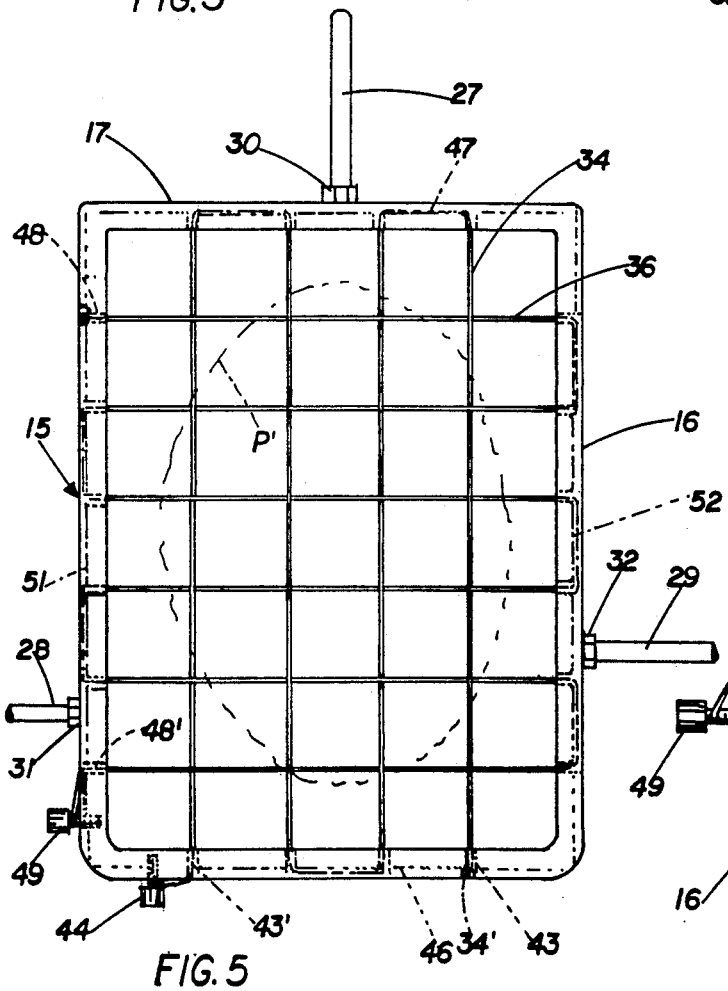
FIG. 5 is a top plan view of the lower mesh wire cutting assembly looking upon continuous strung cutting wires meshed with one another and continuing to tightening knobs that are both located in one corner of the mesh frame.
Figure 6:
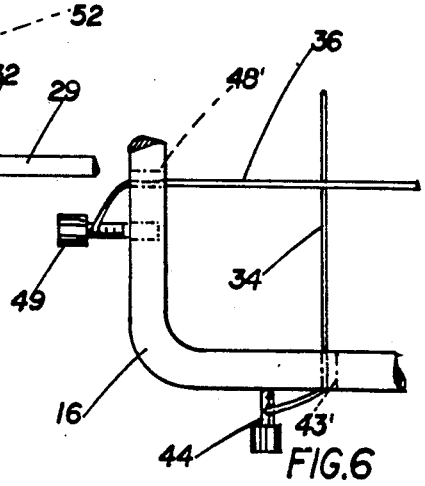
FIG. 6 is an enlarged fragment of the corner of the mesh frame showing the tightening knobs for the respective meshed cutting wires of the bottom dicing assembly.

As will best be seen in FIGS. 5 and 6, the cutting wires 34 and 36 are similarly strung and threaded within the horizontal portion 16. The longitudinal cutting wire 34 is started in an end hole 43 in the trailing end of the horizontal portion 16 and threaded upon the cross connection 26 and to the trailing end until it comes through a hole 43' and wound onto a thumb screw to bring knotted end 34' of wire 34 into the hole 43 and parallel longitudinal lengths fully taught. The trailing end of frame 16 has a recess 46 extending across it to accommodate the end turns of the wire 34 thereacross. In the cross connection 26, there is a similar recess 47 extending thereacross to accommodate end turns of wire 34 at the forward end of portion 16.

The transverse cutting wire 36 is started at 48, over and under longitudinal wire lengths of cutting wire 34 back and forth between the frame sides of the horizontal portion 16 until it passes out hole 48' at the one side of the frame portion 16 and onto a thumb tightening screw 49, FIG. 5. The opposite sides of the frame portion 16 are respectively provided with recesses 51 and 52 to accommodate the end turns of the wire 36. Guitar strings have been used for these cutting wires of length and diameter depending upon work material to be cut and diced. Use may be made of the device for other work pieces, such as raw vegetables or cheese for which a different gauge wire would be selected.

The platform assembly 18 is adapted for attachment upon the raised portion 17 of the bottom mesh grating assembly 15 by simply sliding it down thereover. For effecting the attachment, the platform assembly is provided with an inverted U-shaped member 56 half-round of cylindrical section and bent to the shape of the rod framing of the raised portion 17 to slide and tightly fit upon the same and made home over the top edge of the portion 17 with its legs respectively matching with the respective opposite sides thereof. The inverted, U-shaped member 56 has depending legs 56' and 56''. In order that these legs will be accommodated to nave a smooth sliding fit with the sides of raised portion 17, the end turns of the cutting wire 33 have been embedded respectively in elongated recesses 41 and 42 of the respective sides of the raised portion 17, FIG. 3.

Figure 9:
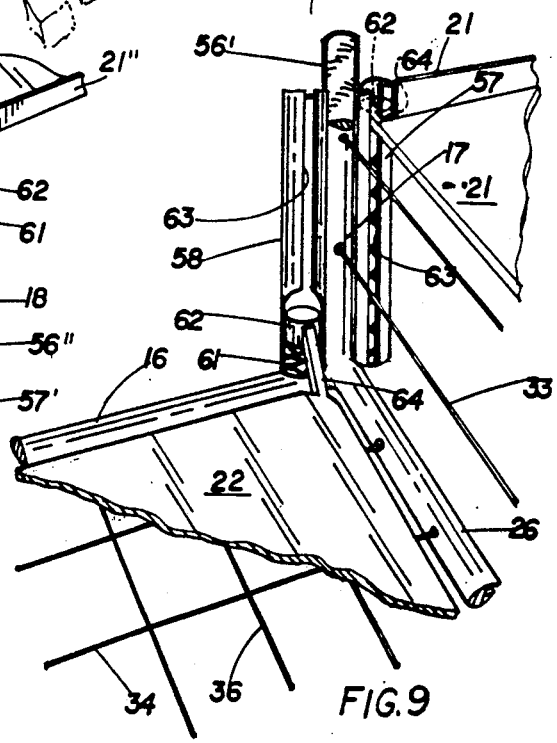
FIG. 9 is an enlarged inside fragmentary perspective view of the lowered final dicing platform upon the wire mesh and looking upon the inner faces of vertical cylinders with one of them opened to show the piston connection with the dicing platform.

Fixed to the leg 56' of the inverted U-shaped member 56, vertically-extending and parallel with one another are slotted cylinder devices 57 and 58, FIG. 9. To the opposite leg 56'' thereof, there is fixed similar vertically-slotted cylinder devices 57' and 58' respectively opposingly corresponding to the respective devices 57 and 58. Each of the four cylinder devices 57, 58, 57', 58' has a compression spring 61 biased to keep a plunger 62 in a raised position and from which there extends a lift arm 64 through slots 63 for securement with platforms 21 and 22, whereby both platforms will normally be held in their raised position. A lift arm 64 extends from the plunger 62 through the slot 63 for rigid connections, so with the corresponding platforms 21 or 22 under the action of the springs 61 and plungers 62, the platforms 21 and 22 when released will be automatically lifted.

In the use of the assemblies together, a potato P is placed on the platform 21 with the hand, FIG. 2, and both forced down to the cross connection 26 in front of the raised cutting wire portion 17 and then the potato is pushed therethrough onto the grating of the horizontal portion 16. Thereafter, the soft boiled potato P is pushed horizontally through the cutting wire lengths of the raised portion 17 to provide horizontally sliced layers of potato that will be delivered onto the grated horizontal portion 16 and beneath the second platform 22. The forcefully lowered platform 21 has raised sides 21' and 21'' to stiffen the platform and to direct and hold the potato against slippage from the platform upon the same being forced down and passed inwardly through the vertical cutting portion 17. With the potato P horizontally-sliced and delivered to the grated horizontal portion 16 as illustrated at P' in FIG. 5 and under platform 22, the final dicing operation may be effected.

Such final operation is illustrated in FIG. 7 where the other hand of the operator is placed upon the platform and on depressing it, the stacked potato slices will be pushed through the grated portion 16 and diced potato cubes 23' will be dropped into pail 24 ready for use in chowders, frying, salads and so on. Thus, there has been provided for use a platform assembly 18 adapted to be releasably fitted upon the bottom wire cutting assembly 15 to provide support 21 for the soft potato while being pushed through the vertical wire slicing portion 17 and a hand pressure plate 22 for pushing the horizontally sliced potato layers through the bottom grated portion 16. It should be understood that the bottom assembly alone is sufficient for effecting the dicing but for application of evenness and uniformity of and pressure to minimize breaking up of the soft potato, the upper platform assembly 18 will be used. A smooth upstanding portion has been provided for the easy slide fitting of the platform assembly 18 upon the grating assembly 15 as the end turns of the cutting wire 33 of the raised portion 17 have been embedded in the framed sides thereof. If slicing of cheese or harder work material is desired to be diced, it should be seen that the single and threaded cutting wire can be easily replaced by a simple rethreading operation and with a wire more suitable for the other work.

While various changes may be made in the detail construction, it shall be understood that such changes shall be within the spirit and scope of this invention as defined by the appended claims.

What is claimed is:

1. A potato dicing device comprising a wire-cutting assembly formed of a closed frame having a horizontal crossed-wire grating portion extending in a horizontal plane and a vertical grating portion bent upwardly therefrom to extend in a plane perpendicular to the horizontal plane said horizontal grating portion having a cross-connection extending between opposite frame sides thereof beneath the vertical grating portion, the opposite frame sides and the cross-connection and a forward end of the closed frame having cutting wire-threading holes, removable cutting wires threaded through the wire-threading holes to provide a crossed-wire grating, opposing sides of the vertical grating portion having thread holes and a cutting wire threaded between the thread holes in the sides of the vertical grating portion, whereby the potato on being pushed through the vertical grating portion is directly delivered to the horizontal grating portion for final dicing of the potato therethrough.

2. A potato dicing device as defined in claim 1 including support rods respectively extending laterally from the frame sides and the cross-connection of the horizontal grating portion which are adapted to extend over a top edge of a pail for supporting the dicing device thereupon for the pail to receive the final potato dicings therefrom.

3. A potato dicing device as defined in claims 1 or 2 wherein the frame sides and the cross-connection of the horizontal grating portion and the opposing sides of the vertical grating portion are recessed to accommodate end turns of the cutting wires threaded therethrough.

4. A potato dicing device as defined in claim 1 including a top platform assembly carried upon the vertical grating portion and having two vertically depressable platforms, one of said platforms extending forwardly from the vertical grating portion on which a potato is placed and pushed through the vertical grating portion onto the horizontal grating portion and the other of said platforms extending rearwardly from the vertical grating portion for pushing the already sliced potato downwardly through the horizontal grating portion to effect the final dicing of the potato into resultant potato cubes.

5. A potato dicing device as defined in claim 4 wherein the opposing sides of the vertical grating portion are recessed to accommodate end turns of the cutting wire threaded therethrough, said top platform assembly including an inverted U-shaped member with depending legs that are removeably slide fitted over the opposing sides of the vertical grating portion, vertically-slotted cylinder devices carried on said depending legs of the inverted U-shaped member, each of said cylinder devices including a spring-biased plunger connected with an opposing plunger of an adjacent said cylinder device which respectively carry the forwardly and rearwardly extending platforms, whereby both platforms are biased to a raised nonuse position.

* * * * *